US006705475B2

(12) United States Patent
Geiger

(10) Patent No.: US 6,705,475 B2
(45) Date of Patent: Mar. 16, 2004

(54) COIN CUP HOLDER FOR USE WITH A GAMING MACHINE

(75) Inventor: Ken Geiger, Las Vegas, NV (US)

(73) Assignee: Caesars Entertainment, Inc., Las Vegas, NV (US)

( * ) Notice: Subject to any disclaimer, the term of this patent is extended or adjusted under 35 U.S.C. 154(b) by 0 days.

(21) Appl. No.: 10/263,899

(22) Filed: Oct. 2, 2002

(65) Prior Publication Data

US 2004/0004049 A1 Jan. 8, 2004

Related U.S. Application Data

(60) Provisional application No. 60/393,669, filed on Jul. 3, 2002.

(51) Int. Cl.[7] ..... A47F 7/00

(52) U.S. Cl. ..... 211/86.01; 211/94.01; 211/59.1; 211/49.1

(58) Field of Search ..... 211/94.01, 49.1, 211/59.1, 162, 86.01

(56) References Cited

U.S. PATENT DOCUMENTS 163,909 A * 6/1875 Balcom
1,625,193 A * 4/1927 Curtin
3,788,487 A * 1/1974 Dawson ..... 211/49.1
4,657,257 A * 4/1987 Lubeck
5,584,454 A * 12/1996 Saunders et al.
5,934,637 A * 8/1999 Robinson
5,996,819 A * 12/1999 Klein ..... 211/49.1 X
6,116,597 A * 9/2000 Rowe et al.

* cited by examiner

*Primary Examiner*—Robert W. Gibson, Jr.
(74) *Attorney, Agent, or Firm*—Weide & Miller, Ltd.

(57) ABSTRACT

A coin cup holder and method of holding coin cups is disclosed. In one embodiment, the coin cup holder comprises an elongate body with a first portion having a first end and an opposing second end and which defines a passage there through and a second portion in the form of a narrow, elongate flange which extends outwardly of the first portion. Extendable rails have one end located in the passage and extend outwardly of each end of the body. Cup accepting posts extend outwardly from the rails in a direction generally opposite the flange. Screws passing through slots in the body and into openings in the rails are used to selectively fix the position of the rails relative to the body between an extended and retracted position. In use, the coin cup holder is mounted by positioning the flange of the coin cup holder between two opposing surfaces, such as opposing sides of two adjacent gaming machines. The rails may be extended or retracted relative to the body, as necessary, so that the posts are appropriately positioned outwardly of the gaming machine (s) a distance sufficient to locate one or more coin cups on the posts.

16 Claims, 3 Drawing Sheets

COIN CUP HOLDER FOR USE WITH A GAMING MACHINE

RELATED APPLICATIONS

This application claims the benefit of U.S. Provisional Patent Application Ser. No. 60/393,669 filed Jul. 3, 2002.

FIELD OF THE INVENTION

The present invention relates to a cup holder and more specifically a device that supports/holds coin cups at a gaming machine.

BACKGROUND OF THE INVENTION

Most gaming machines accept coins or tokens as items of value to comprise a bet or otherwise initiate play of a game at the gaming machine. Likewise, in the case of a winning outcome of a game, the gaming machine may disperse coins or tokens back to the player. As is known, it very difficult to transport more than a few coins/tokens by hand. Thus, most players seek a container to hold and transport the coins/tokens. Casinos generally offer plastic cups to players for this purpose. These coin cups are similar to plastic cups used for drinking and similar purposes, and may include casino advertising, such as the casino name.

Unfortunately, there is no convenient means to dispense these coin cups or organize them once dispensed and used. A casino may place cups for players at a variety of locations, such as at a casino cage or other locations. When a player is using a cup, they generally keep the cup very close to them to maintain a watch over their coins.

Once the player is done using the cup, such as once a player has exhausted their coins or wishes to engage in another activity, the player wishes to dispose of the coin cup. Some players will dispose of the cup in a trash can. Generally, however, this is undesirable since the coin cup is reuseable and its premature disposal is wasteful. Thus, most players leave the cups at various locations for use by other players. It is not uncommon to see the cups strewn throughout a casino including on the floor, on top of garbage cans, and on top of just about any surface upon which the cup may be placed.

The cups in these locations must be collected by casino personnel, or if to be used by a player, sought out. In either event, extra time and effort is necessary to locate or collect the cups.

A device and method for holding coin cups at a gaming machine is desired.

SUMMARY OF THE INVENTION

The present invention is a coin cup holder, such as for holding coin cups at a gaming machine, and a method of holding coin cups, including a method of using the coin cup holder.

In one embodiment, the coin cup holder comprises an elongate body. The body has a first portion and a second portion. The first portion of the body has a first end and an opposing second end and defines a passage there through from the first end to the second end. The second portion of the body extends from the first portion. In one embodiment, the second portion comprises an elongate, narrow flange.

The coin cup holder includes a means for accepting or holding at least one coin cup, and preferably a means for changing the position of the coin cup holding element relative to the body. In one embodiment, the coin cup holding element comprises a post. The means for changing the position of the post comprises a rail.

In one embodiment, a rail is associated with each end of the body. Each rail has a first end adapted to be located in the passage in the body and a second end extending outwardly of an end of the body. A post is connected to the second end of each rail. In one arrangement, the posts have free ends positioned outwardly from the respective rails in a direction generally opposite the flange.

In one embodiment, a means is provided for selectively fixing the position of each rail relative to the body. The means may comprise at least one screw passing through a slot in the body into engagement with the rail.

The coin cup holder is adapted to be mounted to a gaming machine. In use, in a preferred arrangement, the flange of the coin cup holder is positioned between two opposing surfaces. These surfaces are preferably opposing sides of two adjacent gaming machines.

The rails may be extended or retracted relative to the body, as necessary, so that the posts are appropriately positioned. Preferably, the post is positioned outwardly of the gaming machine(s) a distance sufficient to locate one or more coin cups thereon. The position of the post may be fixed by tightening the one or more screws, and may be adjusted by loosening the one or more screws.

The coin cup holder provides a convenient place for coin cups to be stored. The coin cup holder permits storage of the coin cups at the gaming machine where they are closely located for future use. The coin cup holder may also store multiple cups stacked upon one another.

The location of the coin cup holder between the gaming machines is advantageous since the coin cup holder does not interfere with the use or operation of the gaming machines. In addition, the flange mount permits mounting of the coin cup holder without the need of screws, brackets or other independent fastening devices. Instead, the coin cup holder is securely retained in a press-fit relation between the gaming machines.

Further objects, features, and advantages of the present invention over the prior art will become apparent from the detailed description of the drawings which follows, when considered with the attached figures.

DETAILED DESCRIPTION OF THE INVENTION

The invention is a coin cup holder and a method of using a coin cup holder. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises a device for holding coin cups. In a preferred configuration, the device is specifically adapted to be used with at least one gaming machine for holding coin cups adjacent to the machine.

Figure 1:
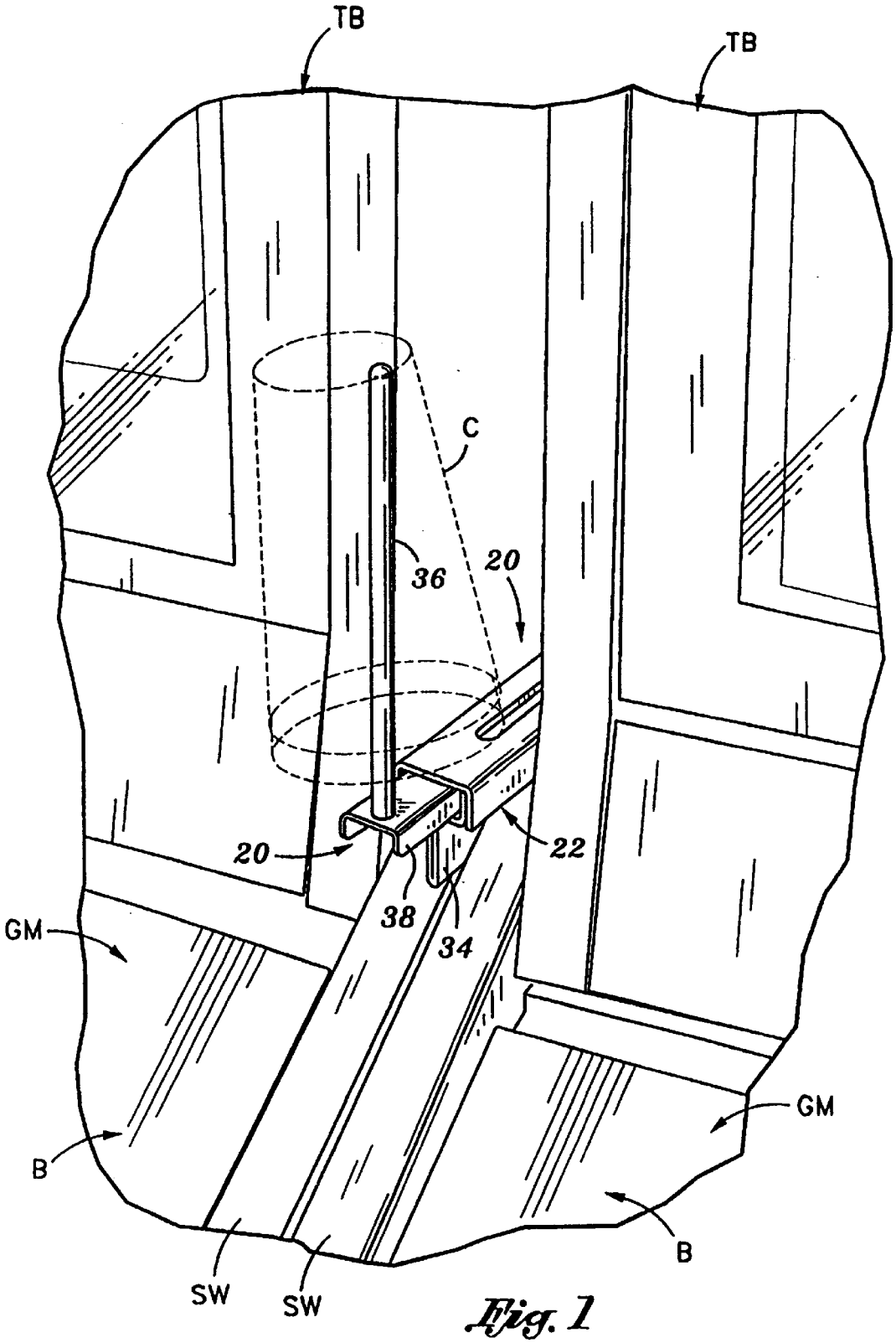
FIG. 1 is a perspective view of portions of two adjacent gaming machines and a portion of a cup holder of the invention used in conjunction therewith.

The invention will first be described generally with reference to FIG. 1. Illustrated in FIG. 1 are portions of two adjacent gaming machines GM and a portion of a cup holder 20 of the invention. The gaming machines GM may be of a variety of types and be arranged to present one or more different types of games to a player. For example, the gaming machines GM may comprise the well-known slot machine or video poker machine, or other types of gaming devices such as video amusement devices.

Generally, each gaming machine GM includes a cabinet for housing and supporting the systems and apparatus necessary to present the game(s) to a player. In one arrangement, as illustrated, each gaming machine GM includes a base portion B and a top box portion TB. The base portion B includes an outer side wall SW. The base portion B may contain the main gaming systems, while the top box TB may contain various displays. Of course, the actual configuration of the gaming machine GM may vary. For example, the gaming machine may have a unitary construction without separate base and top box portions. The gaming machines GM may also have a variety of shapes and sizes. For example, the gaming machines GM may be of the sit-down, slant-top variety, or upright variety.

Casino operators generally locate gaming machines GM in close proximity to one another for a variety of reasons. First, the gaming machines are generally confined to certain areas within the casino. In addition, it is desirable to maximize the use of the floor space to provide as many gaming machines per square foot of casino space as possible. Close location of the machines also facilitates electrical, network and other connections.

As such, it is common practice for the gaming machines GM to be arranged side-by-side and/or back-to-back on the casino floor. In order to minimize the amount of space occupied by the gaming machines, it is common practice for the space between each gaming machine to be minimal. Thus, when positioned side-by-side, the side walls SW of adjacent gaming machines GM abut one another or are otherwise very closely spaced.

As illustrated, the cup holder 20 of the invention is preferably designed to be used with the gaming machines GM to hold one or more coin cups. In a preferred embodiment, the cup holder 20 is self-mounting to the gaming machines GM. So arranged, the cup holder 20 holds one or more coin cups in close proximity to the gaming machines GM for storage and use.

One embodiment of the cup holder 20 of the invention will now be described in greater detail with reference primarily to FIG. 2. As illustrated, the coin cup holder 20 includes a body 22. In a preferred embodiment, the body 22 has a top portion 24, a bottom portion 26 and two ends 28, 30 (referred to hereinafter as the first end and second end).

Figure 3:
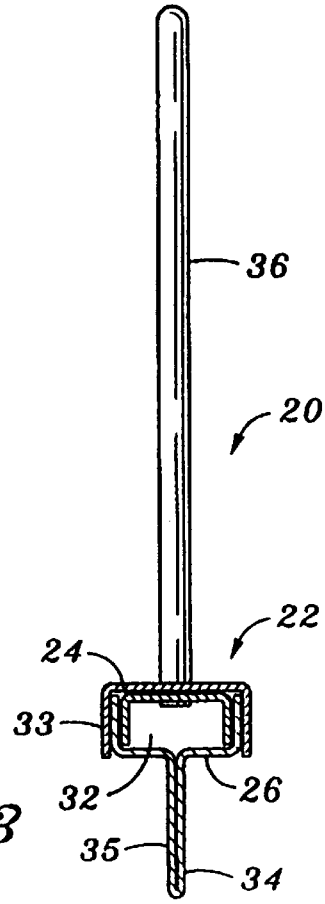
FIG. 3 is a cross-sectional view of the cup holder illustrated in FIG. 2 taken along line 3—3 therein.

The body 22 defines an inner passage 32 as best illustrated in FIG. 3. In one embodiment, the top portion 24 has a generally rectangular, hollow cross-sectional shape and is elongate. The inner passage 32 comprises the hollow interior of the top portion 24. In a preferred embodiment, the inner passage 32 is rectangular in cross-sectional shape and extends from the first end 28 of the body 22 to the second end 30 of the body 22. The top portion 24 defines a substantially enclosed periphery around the inner passage 32.

In accordance with one embodiment of the invention, the bottom portion 26 of the coin cup holder 20 comprises a flange 34 which extends downwardly from the top portion 24. In a preferred embodiment, the flange 34 is narrow in width to enable, as will be explained in further detail below, the flange 34 to fit between two gaming machines.

In one or more embodiments, the flange 34 extends the length of the body 22 from the first end 28 to the second end 30. In other embodiments, the flange 34 may extend less or more than the entire length of the body 22.

Figure 4:
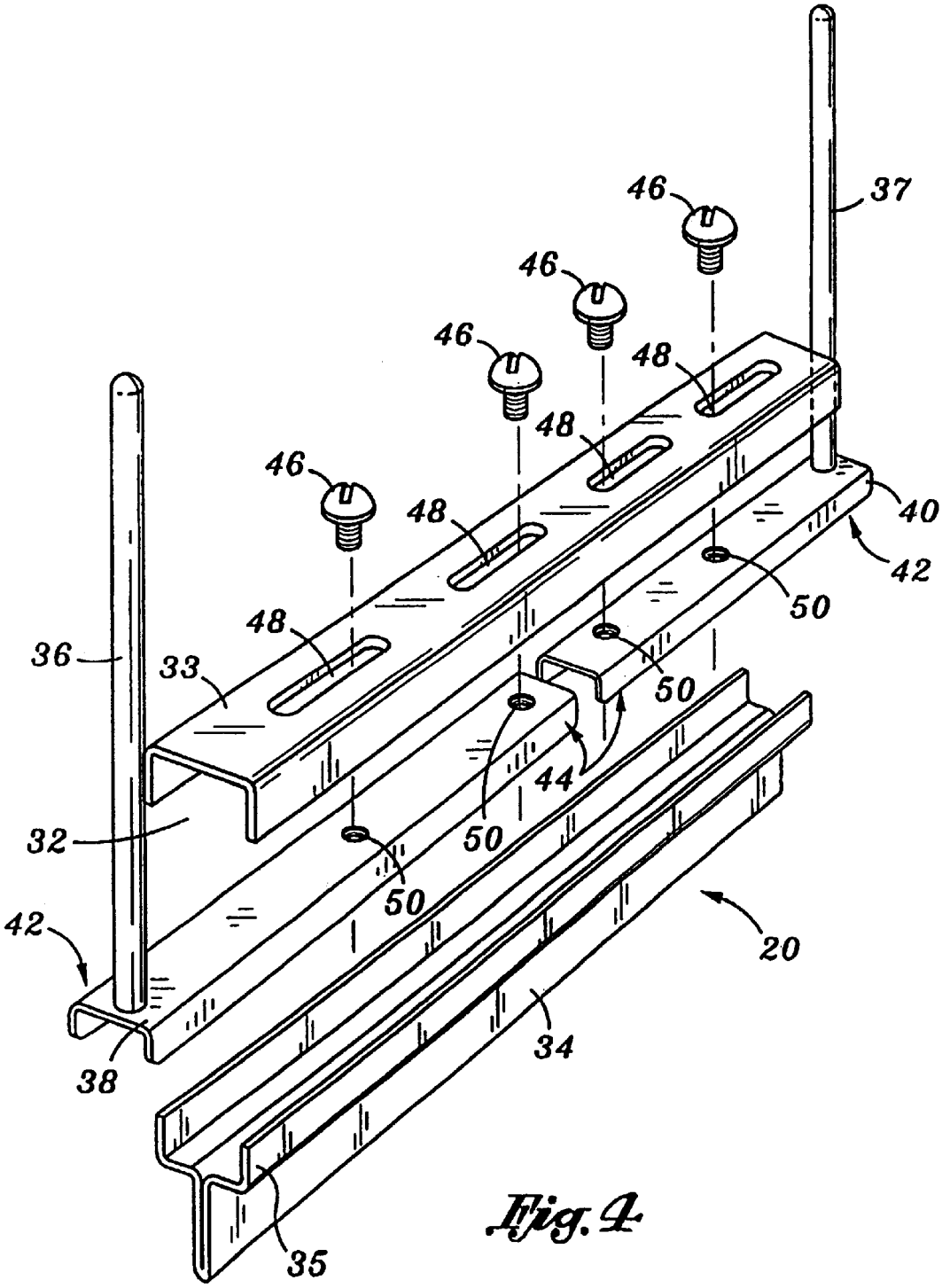
FIG. 4 is an exploded view of the cup holder illustrated in FIG. 2.

The body 22 may be constructed in a variety of manners. Referring to FIGS. 3 and 4, in one embodiment, the body 22 may be constructed from two members 33,35. The first member 33 may comprise an elongate element having a "U" shaped cross-section. The second member 35 may have a top portion having a "U" shaped cross-section for mating with the first member 33 to form the top portion 24 of the body 22. In addition, the second member 35 has a second part comprising the flange 34.

In one embodiment, the first member 33 may comprise an extruded metal or plastic member. Of course, the first member 33 may be constructed of a variety of materials and be manufactured in a variety of manners. As illustrated, in one embodiment the second member 35 comprises a length of metal which has been bent upon itself to define the flange 34 and the mating "U" shaped trough. Of course, the second member 35 may be constructed of a variety of materials and be manufactured in a variety of manners. For example, the second member 35 might also be extruded.

As illustrated in FIG. 1, the coin cup holder 20 includes means for supporting at least one coin cup C. In a preferred embodiment, this means for supporting comprises at least one post. As illustrated, the coin cup holder 20 includes two posts 36,37. These posts 36,37 will be described in greater detail below.

Means are provided for changing the position of the cup holder support(s) relative to the body 22. In one or more embodiments, this means comprises at least one extendable member. In a preferred embodiment, each post 36,37 is connected to an extendable rail 38,40 which is associated with the body 20.

In accordance with the invention, the two extendable rails 38,40 are adapted to fit at least partially within the inner passage 32 of the body 22. As best illustrated in FIG. 4, the extendable rails 38,40 each have a free first end 42 and an opposing second end 44. The first free end 42 is positioned outside of the inner passage 32. The opposing free end 44 is normally located within the inner passage 32 of the body 22.

The extendable rails 38,40 may have a variety of shapes. In one embodiment, the extendable rails 38,40 have a "U"-shaped cross-section. For mounting purposes as disclosed below and to avoid matter from becoming lodged in the rails 38,40, the rails 38,40 are located in the body 22 in an inverted position.

Each rail 38,40 is preferably shorter in length than the length of the body 22. Referring to FIG. 4, each rail 38,40 is in one embodiment slightly longer than one-half of the length of the body 22 so that when extended to a retracted position, each rail 38, 40 is substantially located within the body 22.

In a preferred embodiment, the position of each extendable rail 38,40 relative to the body 22 is selectively adjustable. The extendable rails 38,40 may be moved from a retracted position to an extended position. In the extended position the rails 38,40 extend outwardly from a respective end of the body 22 of the coin cup holder 20. When retracted, the rails 38,40 are substantially located even with the body 22.

Means are provided for selectively fixing the position of the extendable rails 38,40 relative to the body 22. In one or more embodiments, the means for selectively fixing comprises at least one threaded fastener 46, such as a screw. In one embodiment, at least one fastener 46 is used to selectively fix the position of each rail 38,40 to the body 22.

As illustrated, the threaded fasteners 46 are arranged to pass through the top portion 26 of the body 22. To facilitate this, in one or more embodiments, the top portion 26 of the body 22 includes four elongate slots 48. In a preferred configuration, two of the slots 48 are provided corresponding to each rail 38,40.

The fasteners 46 are arranged to pass through the body 22 into engagement with the extendable rails 38,40. In one embodiment, each rail 38,40 includes two fasteners that engage a corresponding opening 50.

Each threaded fastener 46 is associated with each slot 48 in the body 22 and the corresponding opening 50 in the rail 38,40. Thus in one or more embodiments there are two threaded fasteners 46 associated with each rail 38,40. As described in detail below, when engaged or tightened, the fasteners 46 affix the rails 38,40 to the body 22 in one position. When dis-engaged or loosened, the rails 38,40 are permitted to move with respect to the body 22.

It is contemplated that a variety of other means may be provided other than threaded fasteners for selectively fixing the extendable rails 38,40 to the body 22. For example, clamps, clips, ties, an inter-engaging latch and tongue system or the like may be used.

As illustrated, each of the extendable rails 38,40 has one post 36,37 attached thereto. In a preferred embodiment, the posts 36,37 are connected to the rails 38,40 at or near their free ends 42. By the term "end" it is meant herein an area of the rail 38,40 or post 36,37, and not simply the terminus thereof.

In one embodiment, each post 36,37 comprises an elongate cylindrical member, such as a rod. The posts 36,37 have a first end and a second end. The first end is connected to one of the rails 38,40. The second end is arranged to accept one or more coin cups C thereon.

Means are provided for attaching each post 36,37 to one of the extendable rails 38,40. In a preferred embodiment each post 36,37 is connected to its respective extendable rail 38,40 with a threaded fastener. In one embodiment, the threaded fastener passes through the rail 38,40 from the bottom to the top side and engages an opening or passage formed in the first end of the post 36,37 and extending along an axis of the post 36,37.

Other means may be provided for attaching the posts 36,37 to the rails 38,40. For example, in one or more embodiments the posts 36,37 may be permanently attached to the rails 38,40, such as by welding. In another embodiment, the first end of each post 36,37 may be threaded for engaging a mating threaded opening in the first end of each rail 38,40. The posts 36,37 and rails 38,40 may also be integrally formed, such as in a molding process.

One or more embodiments of the invention comprise a method of retaining and/or storing one or more coin cups in conjunction with a gaming machine GM. One such embodiment comprising use of the coin cup holder 20 described above will now be detailed.

In a preferred embodiment, a coin cup holder 20 is associated with at least one gaming machine GM. The preferred embodiment of the coin cup holder 20 illustrated is particularly suited to be used with a pair of adjacent gaming machines GM, as illustrated in FIG. 1.

The coin cup holder 20 is preferably mounted to the one or more gaming machines GM so as to be securely fixed in position. In the preferred embodiment, the coin cup holder 20 is mounted in a press-fit relation between adjacent surfaces of two gaming machines GM. The coin cup holder 20 is advantageously formed with a flange 34 for fitting between such surfaces.

As described, the flange 34 is generally thin and elongate. As illustrated in FIG. 1, this permits the flange 34 to be located between two adjacent gaming machine GM surfaces, such as the outer side walls SW of the machines. When so positioned, the surfaces of the two gaming machines GM engage opposing sides of the flange 34, engaging the flange 34 in a press-fit arrangement.

In one arrangement, the coin cup holder 20 may be located between two pairs of gaming machines GM, i.e. gaming machines located in back-to-back and side-to-side locations. In this arrangement, one end of the coin cup holder 20 is generally located between a first pair of the machines, and the second end of the coin cup holder 20 extends to point between the opposing pair of gaming machines GM. In this configuration, the coin cup holder 20 may be located between opposing surfaces of both pairs of gaming machines GM.

The position of the posts 36,37 may be adjusted as necessary to facilitate their acceptance of coin cups C. For example, in an arrangement where the gaming machines GM are located back-to-back, the posts 36,37 may need to be moved outwardly of the pairs of gaming machines GM to allow coin cups C to be placed thereon.

If it is desired to change the position of the posts 36,37, the fasteners 46 may be disengaged or loosened, and the extendable rails 38,40 moved towards their extended position relative to the body 22. As it will be appreciated, each rail 38,40 may be moved independent of the other. Once in the desired position, the fasteners 46 may be re-engaged or tightened to affix the rails 38,40 to the body 22. Of course, the step of adjusting the position of the posts 36,37 by movement of the rails 38,40 may be performed before or after the coin cup holder 20 is mounted, such as by being placed between the gaming machines GM.

Once mounted, coin cups C may be located on the posts 36,37, as illustrated in FIG. 1. As illustrated, the posts 36,37 are designed to extend upwardly into the interior of the coin cups C when the coin cups C are in their inverted position. Multiple coin cups C may be located on each post C by stacking the cups C upon one another, as also illustrated in FIG. 1.

In accordance with the invention, the coin cup holder 20 provides a convenient means for storing or retaining coin cups C. The coin cups C are conveniently located at the gaming machines GM for use. Further, the coin cup holder 20 is arranged to be mounted to the gaming machines GM without the need for an independent mounting, and without permanent mounting.

The coin cup holder 20 of the invention can also be used with gaming machines GM without the need to move the machines, without the need to modify the machines, and in a manner which does not interfere with the operation or use of the machines. The coin cup holder 20 is configured for mounting in between gaming machines GM at a location where the coin cup holder 20 does not pose a hazard.

Additional aspects of the coin cup holder 20, including arrangements of other embodiments thereof, will now be described.

In one or more embodiments, both the exterior shape of the body 22 and the interior passage 32 it defines may be other than rectangular. In general, it is desirable that the body 22 be shaped and sized to fit between two gaming machines. The interior passage 32 may have a variety of shapes, with the shape and size of the rails 38,40 selected so that the adjustment function as described above is still permitted. For example, the top portion 24 of the body 22 may have a generally circular outer shape, and the inner passage 32 may have a generally circular shape. An advantage of a rectangular or similar passage 32 shape is that when a similar rail shape is utilized, rotation of the rail relative to the body 22 is prevented.

As indicated above, the coin cup holder 20, including its various components, may be formed from of a variety of materials. In one embodiment, the components may be constructed of metal and then painted or coated with a protective and aesthetically pleasing material. Of course, the components need not be constructed of the same material, and the method of manufacturing the components may vary.

In one or more embodiments, the coin cup holder 20 may be configured with or utilized with a single rail. This configuration may be desirable, for example, where the coin cup holder 20 is to be used with a pair of gaming machines GM which are located against a wall. In one configuration, one of the rails may simply be omitted. In another configuration, the length of the body 22 may be adjusted. One end of the body 22 may be closed.

Figure 2:
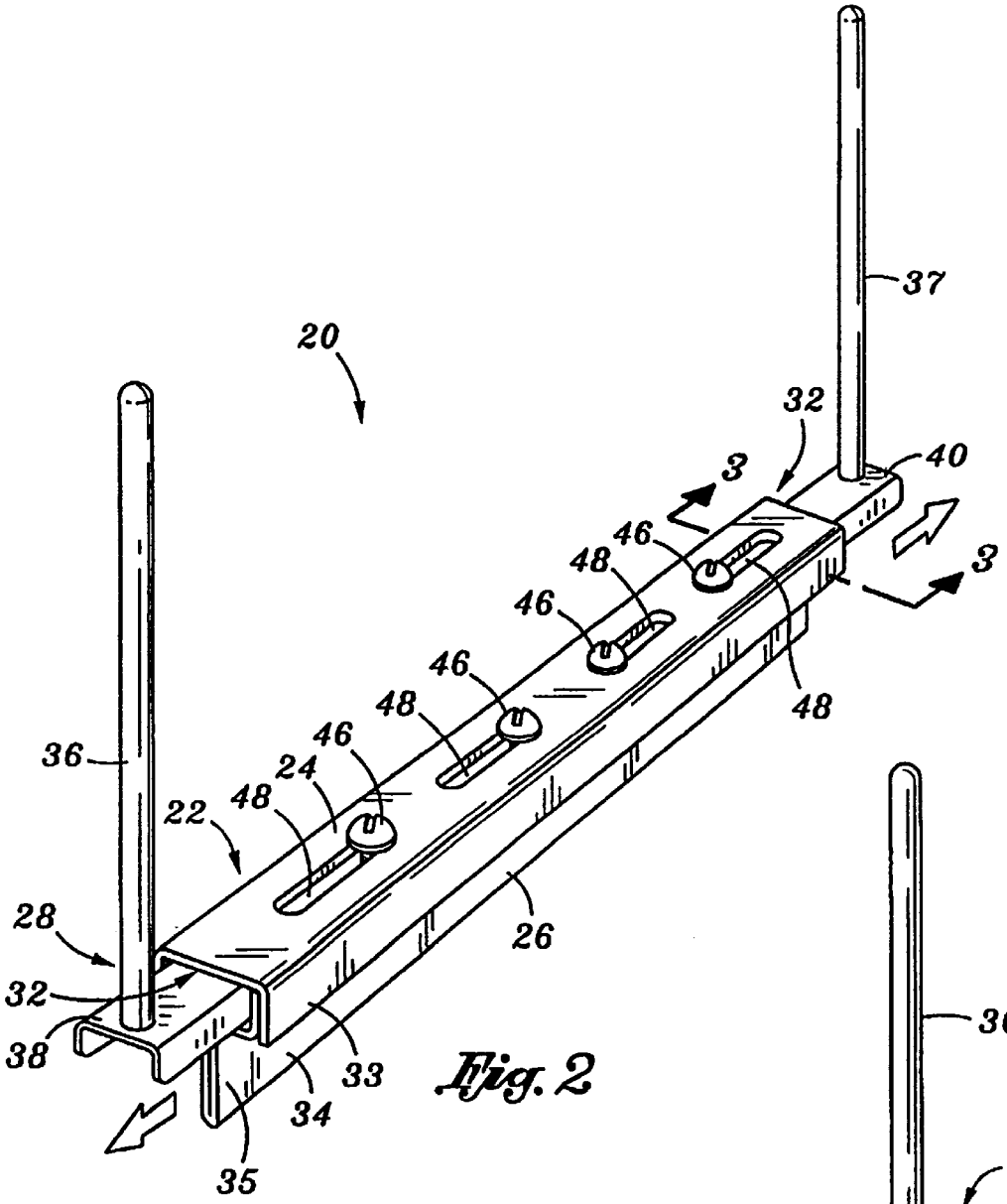
FIG. 2 is a perspective view of one embodiment of the cup holder of the invention.

It will be appreciated now that the means for adjusting the position of the rails 38,40 illustrated in FIG. 2 permits the rails 38,40 to be moved only over a fixed distance. This fixed distance is limited to the length of the slots 48.

In one embodiment,.the fasteners 46 need not engage openings 50 in the rails 38,40, but instead simply bear upon a top surface of the rails 38,40, binding them into a fixed position. In this arrangement, the distance by which the rails may be moved is not limited to the length of the slots 48.

As indicated, a variety of means may be used which permits the position of the rails 38,40 to be adjusted and yet at one or more times be relatively fixed to the body 22. These means may permit incremental adjustment or infinite adjustment over a limited range or the length of the entire rail 38,40.

The rails 38,40 may have a variety of configurations. For example, the rails 38,40 may comprise solid bars. The rails 38,40 may also have a variety of shapes.

Preferably, each post 36,37 has a length sufficient to extend upwardly into a cup C a sufficient distance that the cup C is retained thereon. The exact length of the posts 36,37 may depend upon the size of the largest cup anticipated to be retained.

The posts 36,37 may have other configurations. The posts 36,37 need not be straight or have the shape of rods. As indicated, the posts 36,37 and rails 38,40 may be integrally formed. For example, "L"-shaped members may be used as a post and rail combined element.

It will be appreciated the in the embodiment described, the rails 38,40 may be entirely removed from the body 22. Such a feature facilitates cleaning and repair.

The means for adjusting the position of the posts 36,37 relative to the body 38,40 need not comprise the rails 38,40 or the configuration of the rails as engaging the passage 32 in the body 22. For example, the body 22 may have two parts, the two parts moveable relative to one another to change the length of the body 22. The posts 36,37 may then be connected to the free ends of the two parts of the body 22.

The posts 36,37 may also be connected directly to the body 22 in one or more locations. For example, the body 22 may be elongate and include a number of threaded openings there along. The posts 36,37 may be configured to screw into the openings.

The coin cup holder 20 may be of a variety of sizes. For example, the length of the body 22 may vary depending upon the particular use. Likewise, the length of the rails 38,40 and the height of the posts 36,37 may vary. As also indicated, the length of the flange 34 may vary, and need not extend along the entire length of the body 22. The distance that the flange 34 extends outwardly from the body 34 may also vary.

Other means may be provided for mounting the coin cup holder 20 than the press-fit engagement of the flange 34. For example, screws or other fasteners may be passed through the flange 34 into engagement with the side wall SW of a gaming machine GM. The coin cup holder 20 may also be mounted to one or more gaming machines GM with separate brackets or mounts.

It will be appreciated that the coin cup holder 20 of the invention may be used in a variety of environments other than in a casino with gaming machines. For example, the coin cup holder 20 may be used in conjunction with washing machines in a laundromat. In such event, the coin cup holder 20 may be mounted in a variety of manners. The coin cup holder 20 could be mounted with the flange between adjacent washing machines.

It is also contemplated that the coin cup holder 20 be mounted between not only two devices, such as two gaming machines, but one device and a wall or other combinations of opposing surfaces.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A coin cup holder comprising:

an elongate body, said body having a first portion and a second portion, said first portion having a first end and an opposing second end and defining a passage there through from said first end to said second end, said second portion extending from said first portion, said second portion comprising a narrow flange;

at least one rail having a first end adapted to be located in said passage and a second end extending outwardly of one of said ends of said body; and a post connected to the second end of said at least one rail, said post having a free end positioned outwardly from said rail in a direction generally opposite said flange, said post adapted to accept at least one coin cup thereon.

2. The coin cup holder in accordance with claim 1 including a first rail and a second rail, said first rail extending from said first end of said body and said second rail extending from said second end of said body.

3. The coin cup holder in accordance with claim 1 wherein said passage has a generally rectangular cross-section and said at least one rail has a "U"-shaped cross-section.

4. The coin cup holder in accordance with claim 1 including means for selectively fixing the position of said at least one rail with respect to said body.

5. The coin cup holder in accordance with claim 4 wherein said means for selectively fixing comprises at least one threaded fastener, said threaded fastener arranged to extend through a slot in said body into an opening in said at least one rail located in said passage.

6. The coin cup holder in accordance with claim 1 wherein said body is constructed from a first part and a second part, said first part defining said flange and a portion of said passage and said second part defining a remaining portion of said passage.

7. The coin cup holder in accordance with claim 1 wherein said body has four slots therein and wherein said coin cup holder includes two rails, each rail having a pair of openings therein, and including at least one threaded fastener for engaging each slot in said body and a corresponding one of said openings in said rails.

8. The coin cup holder in accordance with claim 1 wherein said post attached to said at least one rail comprises a generally cylindrical rod.

9. A method of storing coin cups at a gaming machine comprising:

locating a flange portion of a coin cup holder between opposing surfaces of at least two gaming machines;

locating at least one cup holding element of said coin cup holder at a position outwardly of said at least two gaming machines for accepting one or more cups thereon; and accepting one or more cups on said coin cup holder.

10. The method in accordance with claim 9 wherein said step of locating said at least one cup holding element comprises extending a rail of said cup holder from a body thereof, said rail having a post extending upwardly therefrom.

11. The method in accordance with claim 10 including the step of affixing a position of said rail with respect to said body once said rail has been extended.

12. The method in accordance with claim 9 wherein said step of locating said at least one cup holding element comprises extending a rail from each of two opposing ends of a body of said cup holder.

13. In combination, a pair of gaming machines and a coin cup holder, said gaming machines located side-by-side and having an outer surface, said coin cup holder having a flange having a first side and an opposing second side, said flange located between opposing surfaces of said gaming machines such that said first side of said flange contacts said outer surface of one of said gaming machines and said second side of said flange contacts said outer surface of the other of said gaming machines, whereby said flange is maintained in a fixed position by the contact of said gaming machines therewith, said coin cup holder having a body supporting at least one cup holding element.

14. The combination in accordance with claim 13 wherein said coin cup holder has a body comprising a first portion and a second portion, said first portion defining a passage and said second portion comprising said flange.

15. The combination in accordance with claim 14 wherein said at least one cup holding element comprises an upstanding post.

16. The combination in accordance with claim 15 wherein said coin cup holder includes a rail, said rail having a first end positioned in said passage and said post extending outwardly from said rail.

* * * * *